US006102005A

United States Patent [19]

Kasen et al.

[11] Patent Number: 6,102,005

[45] Date of Patent: Aug. 15, 2000

[54] ADAPTIVE CONTROL FOR POWER GROWTH IN AN ENGINE EQUIPPED WITH A HYDRAULICALLY-ACTUATED ELECTRONICALLY-CONTROLLED FUEL INJECTION SYSTEM

[75] Inventors: Jon E. Kasen, East Peoria; Thomas G. Ausman, Metamora, both of Ill.

[73] Assignee: Caterpillar Inc., Peoria, Ill.

[21] Appl. No.: 09/020,357

[22] Filed: Feb. 9, 1998

[51] Int. Cl.[7] ..... F02M 37/04

[52] U.S. Cl. ..... 123/446; 123/494; 73/119 A

[58] Field of Search ..... 123/478, 480, 123/494, 357, 458, 446, 447, 381; 73/119 A, 117.3

[56] References Cited

U.S. PATENT DOCUMENTS

| | | | |
|---|---|---|---|
| 3,946,714 | 3/1976 | Eckert et al. | 123/139 |
| 4,015,569 | 4/1977 | Leshner et al. | 123/133 |
| 4,037,467 | 7/1977 | Emerson . | |
| 4,206,634 | 6/1980 | Taylor et al. . | |
| 4,372,266 | 2/1983 | Hiyama et al. | 123/357 |
| 4,438,496 | 3/1984 | Ohie | 364/431.05 |
| 4,487,181 | 12/1984 | Moore et al. . | |
| 4,610,233 | 9/1986 | Kushida et al. | 123/458 |
| 4,667,633 | 5/1987 | Stumpp et al. | 123/357 |
| 4,763,626 | 8/1988 | Staerzl . | |
| 4,777,921 | 10/1988 | Miyaki et al. | 123/456 |
| 4,844,035 | 7/1989 | Takagi | 123/446 |
| 5,058,553 | 10/1991 | Kondo et al. | 123/456 |
| 5,131,371 | 7/1992 | Wahl et al. | 123/458 |
| 5,168,855 | 12/1992 | Stone | 123/446 |
| 5,176,122 | 1/1993 | Ito | 123/447 |
| 5,186,138 | 2/1993 | Hashimoto | 123/198 |
| 5,191,867 | 3/1993 | Glassey | 123/447 |
| 5,197,438 | 3/1993 | Yamamoto | 123/506 |
| 5,257,607 | 11/1993 | Gillespie | 123/478 |
| 5,297,523 | 3/1994 | Hafner et al. . | |
| 5,313,924 | 5/1994 | Regueiro | 123/456 |
| 5,392,749 | 2/1995 | Stockner et al. | 123/470 |
| 5,404,855 | 4/1995 | Yen et al. | 123/446 |
| 5,423,302 | 6/1995 | Glassey | 123/381 |
| 5,441,027 | 8/1995 | Buchanon et al. | 123/446 |
| 5,459,664 | 10/1995 | Buckalew . | |
| 5,477,828 | 12/1995 | Barnes | 123/446 |
| 5,485,820 | 1/1996 | Iwaszkiewicz | 123/458 |
| 5,560,340 | 10/1996 | Tomiswa | 123/494 |
| 5,564,391 | 10/1996 | Barnes et al. . | |
| 5,575,264 | 11/1996 | Barron . | |
| 5,586,538 | 12/1996 | Barnes . | |
| 5,634,448 | 6/1997 | Shinoge et al. . | |
| 5,641,891 | 6/1997 | Frankl et al. . | |
| 5,697,339 | 12/1997 | Esposito . | |
| 5,732,675 | 3/1998 | Yoshida et al. | 123/494 |
| 5,747,684 | 5/1998 | Pace et al. . | |
| 5,806,497 | 9/1998 | Hosoya | 123/494 |
| 5,839,420 | 11/1998 | Thomas . | |

FOREIGN PATENT DOCUMENTS

| | | | |
|---|---|---|---|
| 0 391 573 | 10/1990 | European Pat. Off. | F02D 41/14 |
| 2 314 946 | 1/1998 | United Kingdom | F02D 41/38 |

*Primary Examiner*—Thomas N. Moulis
*Attorney, Agent, or Firm*—Michael McNeil

[57] ABSTRACT

A method of fuel injection comprises an initial step of providing an electronically-controlled hydraulically-actuated fuel injector. An on-time for the fuel injector that corresponds to a desired amount of fuel is determined. The fuel injector is activated for that on-time. Next, the actual amount of fuel injected by the fuel injector is estimated. The actual amount of fuel is compared to the desired amount of fuel. If the actual amount of fuel is substantially more than the desired amount of fuel, the on-time for a subsequent injection event is adjusted.

20 Claims, 2 Drawing Sheets

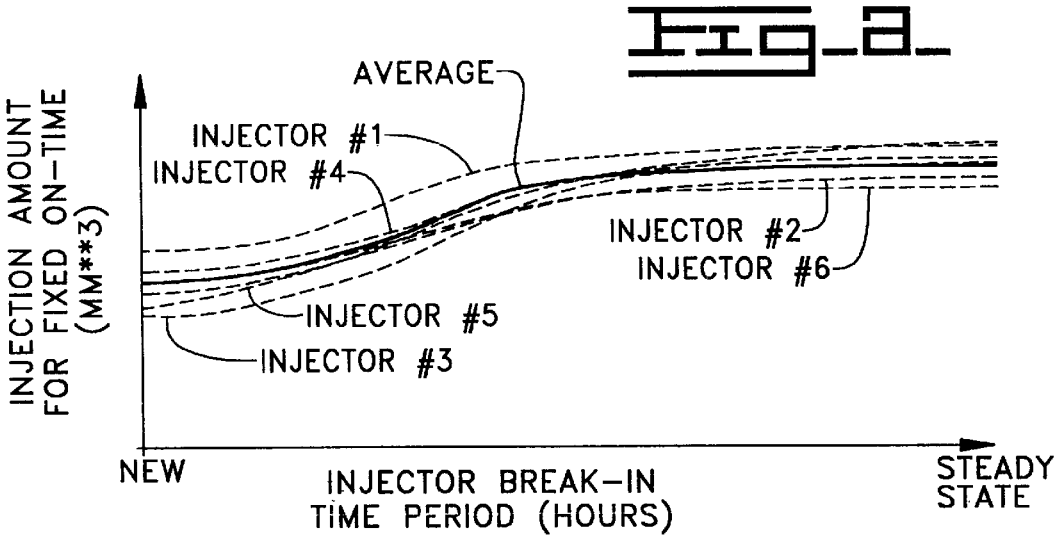
Fig_2_
AVERAGE
INJECTOR #1
INJECTOR #4
INJECTOR #2
INJECTOR #6
INJECTOR #5
INJECTOR #3
INJECTION AMOUNT FOR FIXED ON-TIME (MM**3)
NEW
INJECTOR BREAK-IN TIME PERIOD (HOURS)
STEADY STATE

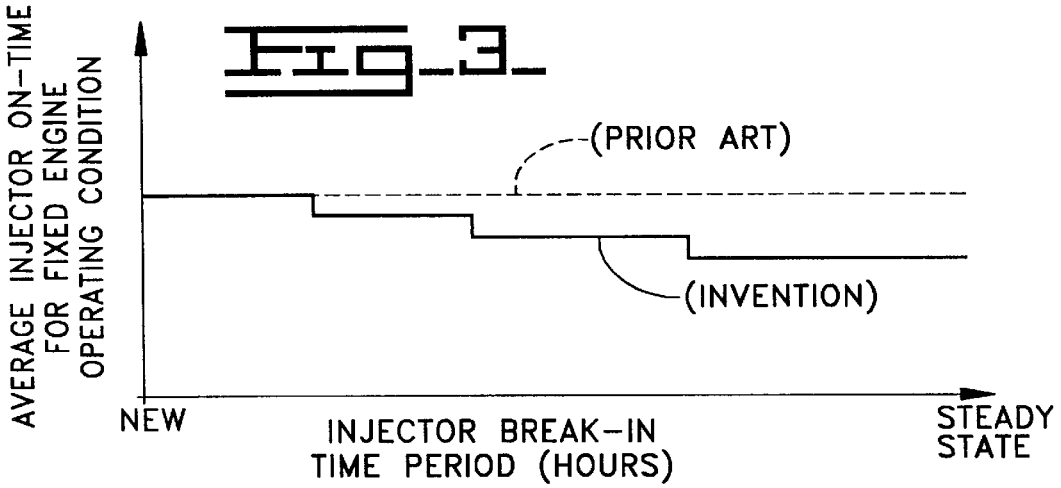
Fig_3_
(PRIOR ART)
(INVENTION)
AVERAGE INJECTOR ON-TIME FOR FIXED ENGINE OPERATING CONDITION
NEW
INJECTOR BREAK-IN TIME PERIOD (HOURS)
STEADY STATE

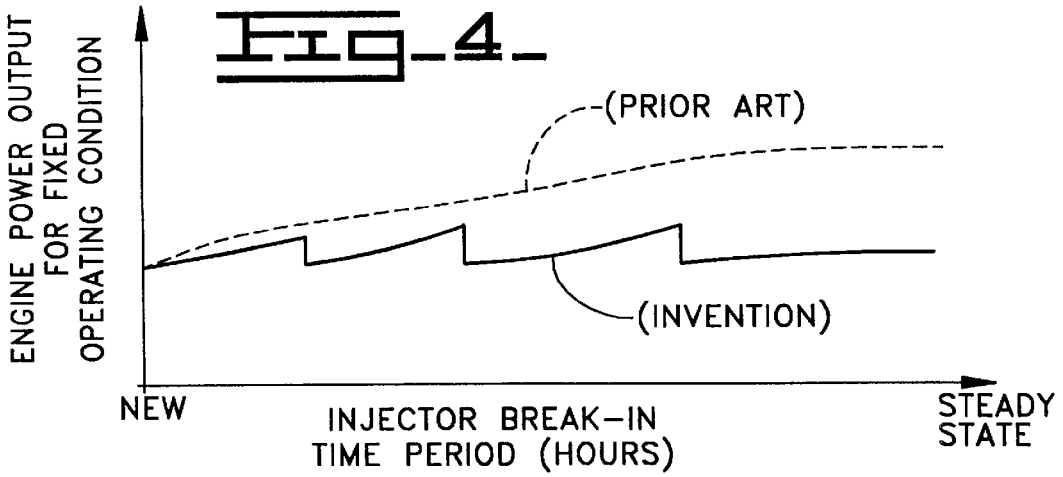
Fig_4_
(PRIOR ART)
(INVENTION)
ENGINE POWER OUTPUT FOR FIXED OPERATING CONDITION
NEW
INJECTOR BREAK-IN TIME PERIOD (HOURS)
STEADY STATE

ADAPTIVE CONTROL FOR POWER GROWTH IN AN ENGINE EQUIPPED WITH A HYDRAULICALLY-ACTUATED ELECTRONICALLY-CONTROLLED FUEL INJECTION SYSTEM

TECHNICAL FIELD

The present invention relates generally to hydraulically-actuated electronically-controlled fuel injection systems, and more particularly to such systems with the ability to sense changes in, and make adjustments to, its operation.

BACKGROUND ART

Like numerous other mechanical devices that contain many moving parts, hydraulically-actuated fuel injectors tend to have a break-in period. Engineers have observed that the amount of fuel actually injected from a hydraulically-actuated fuel injector will grow over time until reaching a steady state after a break-in period. In other words, engineers have observed that, for a fixed activation on-time, the amount of fuel actually injected from a hydraulically-actuated fuel injector can typically increase a measurable percentage over an initial break-in period, which is typically on the order of hours of operation. This increased output from the fuel injection system often reveals itself as power growth in the engine in which the fuel injectors are mounted.

In a typical hydraulically-actuated electronically-controlled fuel injection system, an electronic control module commands the individual fuel injectors to activate for an on-time that is determined from a number of sensor inputs. For instance, the activation on-time for an individual injector will preferably be optimized for a particular performance parameter based upon a number of sensor inputs to the electronic control module, including engine speed and load conditions, throttle position, etc. Instead of continuously calculating preferred fuel injection on-times during the operation of the engine, the electronic control module typically includes or has access to a memory unit containing a multi-dimensional map having recorded injector on-times for each different combination of operation variables. Once established, the recorded map of injector on-times are not adjusted to compensate for performance changes that naturally occur during the break-in period of new fuel injectors. In some instances, particularly relating to smaller sized engines, the power growth observed due to the fuel injector break-in phenomenon is less than desirable.

The present invention is directed to sensing changes in, and adjusting, fuel injection system operation to control performance output of the injection system.

DISCLOSURE OF THE INVENTION

In one embodiment, a method of fuel injection comprises an initial step of providing an electronically-controlled hydraulically-actuated fuel injector. An on-time for the fuel injector that corresponds to a desired amount of fuel is determined. The fuel injector is activated for the on-time. The actual amount of fuel injected by the fuel injector is then estimated. The actual amount of fuel is compared to the desired amount of fuel. A subsequent on-time is adjusted if the actual amount of fuel is substantially more than the desired amount of fuel.

In another aspect, a method of fuel injection comprises the initial step of providing an electronically-controlled hydraulically-actuated fuel injector. The fuel injector is operated with a nominal on-time for a plurality of injection cycles. Next, it is determined whether the injection amount from the fuel injector for the nominal on-time has changed by a certain percentage. If so, the fuel injector is operated with an adjusted on-time.

In still another aspect, a hydraulically-actuated fuel injection system includes a common rail containing a pressurized actuation fluid. A plurality of electronically-controlled hydraulically-actuated fuel injectors are connected to the common rail. Means, including an electronic control module and a sensor, are provided for estimating an amount of fuel actually injected by the fuel injectors.

BRIEF DESCRIPTION OF THE DRAWINGS

FIG. 2 is a graph of injection amount for a fixed on-time versus injector break-in time period for a plurality of fuel injectors in a fuel injection system.

FIG. 3 is a graph of average injector on-time for a fixed engine operating condition versus injector break-in time period for the prior art and according to the present invention.

FIG. 4 is a graph of engine power output for a fixed operating condition versus injector break-in time period according to the prior art and present invention.

BEST MODE FOR CARRYING OUT THE INVENTION

Figure 1:
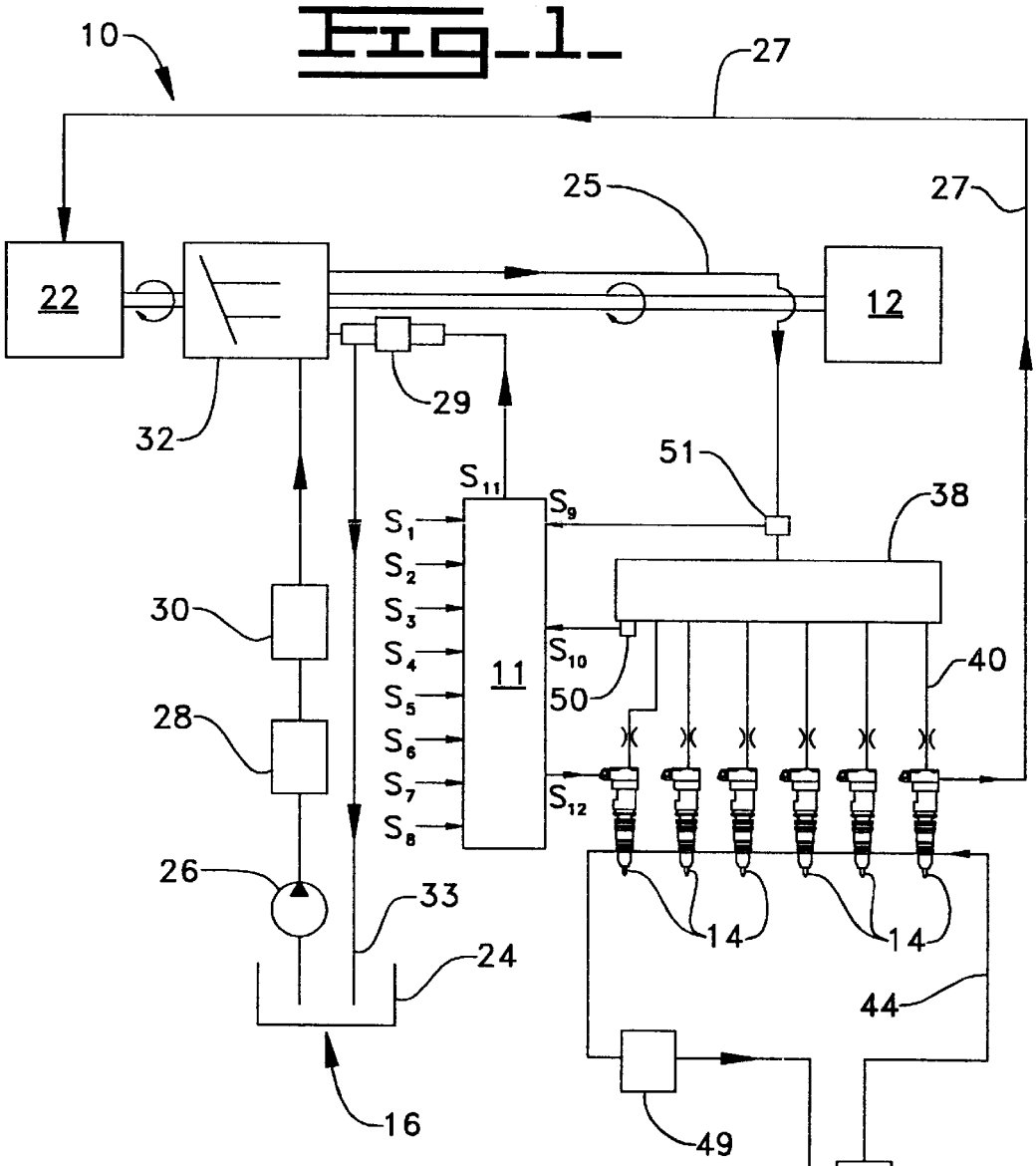
FIG. 1 is a schematic illustration of a hydraulically-actuated electronically-controlled fuel injection system according to the present invention.

Referring now to FIG. 1, a hydraulically-actuated electronically-controlled fuel injection system 10 includes six hydraulically-actuated electronically-controlled fuel injectors 14 mounted in an engine 12. The operation of system 10 is controlled by a conventional electronic control module 11. In this preferred embodiment, the fuel injectors are hydraulically-actuated using a fluid, such as engine lubricating oil, supplied by an actuation fluid system 16. Those skilled in the art will appreciate that in some instances, different fluids, including the possibility of fuel fluid, could be used to actuate the individual fuel injectors. Fuel is supplied to the individual fuel injectors 14 by a separate fuel supply system 18.

The fuel supply system 18 includes a fuel tank 42 that is connected to a fuel supply passage 44 and a fuel return passage 47. A fuel pump 46 draws fuel out of tank 42 and passes the fuel through a filter 48 before the same is circulated freely between the fuel inlets of fuel injectors 14 via a fuel rail (not shown). A fuel supply regulating valve 49, which is preferably positioned in fuel return passage 47, maintains the fuel supplied to the individual fuel injectors 14 at a predetermined pressure, which is relatively low. In this example, engine 12 is a six cylinder diesel engine that utilizes distillate diesel fuel. Those skilled in the art will appreciate that the principles of the present invention are equally applicable to other types of internal combustion engines having something other than six combustion spaces.

A low pressure pump 26 draws oil from a sump 24, and pushes the same toward a high pressure pump 32 via an actuation fluid cooler 28 and an actuation fluid filter 30. High pressure pump 32, which is preferably a swash plate type pump driven directly by engine 12, supplies high pressure oil to a high pressure common rail 38 via an actuation fluid supply passage 25. The actuation fluid inlet of each of the individual fuel injectors 14 is connected to high pressure common rail 38 via an individual branch passage 40. Pressure in common rail 38 is maintained by a rail pressure control valve 29, which returns an amount of the high pressure oil produced by pump 32 back to sump 24 via actuation fluid return passage 33. After the actuation fluid has performed work in the individual fuel injectors 14, the same is returned to a hydraulic energy recirculating means 22 via an actuation fluid recirculation passage 27. A portion of the fluid from hydraulic energy recirculating means 22 is returned to high pressure rail 38 via actuation fluid supply passage 25 by pump 32, and another portion is returned by rail pressure control valve 29 to sump 24.

Fuel injection system 10 is controlled by electronic control module 11 primarily through two different signals: $S_{11}$ and $S_{12}$. $S_{11}$ represents an actuation fluid pressure control signal that controls the amount of fluid spilled that is returned to sump 24 by rail pressure control valve 29. The amount of fluid returned by rail pressure control valve 29 in turn provides a means for controlling the magnitude of pressure in high pressure common rail 38. The individual injection events are controlled by fuel injector solenoid control signal $S_{12}$. The solenoid of each of the fuel injectors 14 is controlled independently, but in order to avoid confusion only one solenoid control signal $S_{12}$ is shown in FIG. 1. Solenoid control signal $S_{12}$ represents electric current supplied to an injector solenoid for a fixed duration and timing which is determined by electronic control module 11 based upon sensor inputs in a conventional manner.

When in operation, electronic control module 11 relies upon a number of sensor input signals $S_1$–$S_{10}$ to determine control signals $S_{11}$ and $S_{12}$. In this example, $S_1$ represents engine speed, $S_2$ is engine crank shaft position, $S_3$ is engine coolant temperature, $S_4$ is engine exhaust back pressure, $S_5$ is air intake manifold pressure, $S_6$ is actuation fluid pressure, $S_7$ is throttle position, $S_8$ is transmission operating condition, $S_9$ is actuation fluid flow rate, and $S_{10}$ is actuation fluid temperature. Sensor input $S_9$ is supplied to electronic control module 11 by an actuation fluid supply flow sensor that is positioned in actuation fluid supply passage 25. Actuation fluid temperature signal $S_{10}$ is provided by a temperature sensor 50, which could be located anywhere in the actuation fluid supply system 16, but is shown in this embodiment as attached to high pressure rail 38.

Figure 1A:
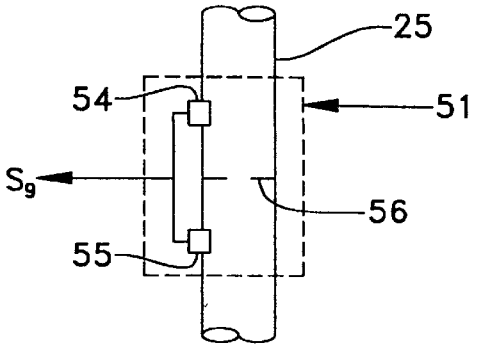
FIG. 1A is a schematic illustration of a flow rate sensor according to one aspect of the present invention.

In the present case, actuation fluid supply flow sensor 51 preferably takes the form of a differential pressure sensor that includes a first transducer 54 and a second transducer 55 that are located on opposite sides of a flow orifice 56 positioned in supply passage 25, as shown in FIG. 1A. By knowing the differential pressure across flow orifice 56, the volume flow rate through orifice 56 can be calculated. This calculated flow rate in turn corresponds to the rate at which actuation fluid is being consumed by the full set of fuel injectors 14. Since the amount of actuation fluid being consumed by the fuel injectors is proportional to the amount of fuel actually being injected, the average amount of fuel being injected by the individual fuel injectors can be estimated from the differential pressure signal produced by the sensor 51. Those skilled in the art will appreciate that other types of sensors could be used to measure flow rate through supply passage 25, other than the pressure differential sensor illustrated in FIG. 1A.

In this embodiment of the present invention, the electronic control module 11 is able to estimate the amount of fuel actually injected by fuel injectors 14 by measuring the amount of actuation fluid that enters high pressure rail 38 with flow sensor 51. This is accomplished because the amount of actuation fluid consumed by the fuel injectors 14 is equal to the amount of actuation fluid supplied to high pressure rail 38. In addition, the amount of fuel injected by the fuel injectors 14 is proportional to the amount of actuation fluid consumed by the injectors 14 when performing injection events. Thus, by knowing the amount of actuation fluid that enters high pressure common rail 38, one should be able to estimate the amount of fuel actually being injected by fuel injectors 14. The present invention therefore provides a means by which the average amount of fuel injected by each individual fuel injector 14 in each injection event can be estimated.

The amount of fuel actually injected can be compared by electronic control module 11 to the amount of fuel that was desired to be injected. The desired amount of fuel is a function of the various sensor input variables, and the desired amounts of fuel for various conditions are stored in a memory unit that is part of and accessible to electronic control module 11 as a plurality of different fuel injector on-times. These stored on-times can be thought of as nominal on-times that have been developed over time through testing, observation and a variety of other techniques to optimize one or more different performance parameters, such as power output and/or exhaust emissions at a particular operating condition. Since the present invention can compare an estimated actual amount of fuel injected to an on-time corresponding to a desired amount of fuel, the present invention provides the ability to calculate an adjusted on-time that will cause the individual fuel injectors to actually inject an amount of fuel that more closely matches the desired amount of fuel to be injected.

INDUSTRIAL APPLICABILITY

Referring now in addition to FIGS. 2–4, various graphs are provided to illustrate how the present invention could work after a set of new fuel injectors are installed in engine 12. FIG. 2 illustrates the fact that for a fixed on-time all of the injectors will inject an amount of fuel that varies slightly, which is due to the large number of moving parts in the individual fuel injectors and the tolerancing relative to these parts. It has been observed that over a break-in time period, the amount of fuel actually injected from each one of the individual injectors will grow to a higher steady state amount. This increase generally falls within a measurable range. Thus, the amount of fuel actually injected varies among the individual fuel injectors, and also varies with time during a break-in period until the injectors achieve their own steady state performance output. The present invention is directed to the performance changes that occur by all injectors during the break-in time period. Nevertheless, those skilled in the art will recognize that, with appropriate programming, electronic control module 11 could be made to also adjust initial nominal on-times in order to insure that the average performance of the fuel injectors corresponds to a desired initial performance level.

In the preferred embodiment of the present invention illustrated in FIG. 1, it is only possible to estimate the average amount of fuel injected for a given on-time. This is because only a single supply flow sensor 51 is utilized. If it is desired to provide a better estimate of the actual amount of fuel being injected by each individual injector, those skilled in the art will appreciate that separate flow rate sensors could be positioned in each of the branch passages 40. This multiple sensor alternative could also be used by the electronic control module to fine tune the on-times for each injector so that all of the injectors perform substantially uniformly at a particular operating condition. Another alternative to the embodiment shown in FIG. 1 would be to provide some means of actually measuring the amount of fuel that enters each of the individual fuel injectors, or by calculating an average amount of fuel injected by subtracting flow rate in fuel return passage 47 from the flow rate in fuel supply passage 44. In any event, there exists a variety of means and methods by which the actual amount of fuel injected can be estimated.

A number of options also exist for choosing how to establish an initial set of nominal on-times after the fuel injectors are first installed in an engine. One option might be to record a set of nominal on-times that correspond to known average performance characteristics of all fuel injectors, which could be based upon known techniques such as computer modeling and/or factory testing. Another option might be to program the electronic control module to record a set of nominal on-times during the first initial period of operation of the engine after the fuel injectors have been installed. Still another option might be to ascertain the performance characteristics of each individual injector, and then program the electronic control module to recognize the operational differences between the individual injectors at the time of installation. In any event, a set of nominal on-times is recorded that should correspond to a desired amount of fuel injected when the individual injectors are first installed in the engine.

After the system has operated for a number of hours, the fuel injectors begin to be broken in and the amount of fuel actually injected for a fixed on-time begins to increase as shown in FIG. 2. When the amount of this increase exceeds a predetermined percentage, the electronic control module adjusts some or all of the on-time maps to make the amount of fuel actually injected more closely match the amount of fuel that was desired to be injected. Preferably, a correction is only made if the amount of fuel injected increases a predetermined measurable amount. FIGS. 3 and 4 illustrate that in one example system, three on-time adjustments have been made in order to maintain the engine power output within a small percentage of the known and expected power output for a fixed operating condition. These graphs also illustrate that when the injector on-times are maintained fixed as shown in the prior art line of FIG. 3, the engine power output naturally grows to a higher steady state during the injector break-in time period. The present invention, on the other hand, maintains power output from the engine substantially uniform.

Because the present invention has the ability to both measure the temperature of the actuation fluid as well as its flow rate into the high pressure common rail, these two sensor inputs can be used by the electronic control module to calculate the viscosity of the oil used to actuate the fuel injectors. Since the viscosity can be determined, the operation of the fuel injection system in a cold mode can be significantly simplified. If the electronic control module can determine viscosity, the desired on-times for injection events can be adjusted to better compensate for higher viscosity during a cold mode of operation. In this way, the fuel injector on-times could be lengthened so that they have a better ability to accurately inject a desired amount of fuel.

The above description is intended for illustrative purposes only, and is not intended to limit the scope of the present invention in any way. For instance, those skilled in the art will appreciate that the actual amount of fuel injected by the fuel injectors can be estimated and/or measured in a wide variety of ways. Thus, various modifications can be made to the disclosed embodiment without departing from the spirit and scope of the invention, which is defined in terms of the claims as set forth below.

What is claimed is:

1. A method of fuel injection comprising the steps of:

providing an electronically-controlled hydraulically-actuated fuel injector installed in an engine;

supplying a relatively low pressure fuel to said fuel injector;

determining an on-time for said fuel injector that corresponds to a desired amount of fuel;

activating said fuel injector for said on-time at least in part by hydraulically pressurizing fuel in said fuel injector to a relatively high pressure;

estimating an actual amount of fuel injected by said fuel injector;

comparing said actual amount of fuel to said desired amount of fuel; and adjusting a subsequent on-time if said actual amount of fuel is substantially more than said desired amount of fuel.

2. The method of claim 1 wherein said fuel injector is connected to a source of pressurized actuation fluid; and said estimating step includes a step of estimating how much actuation fluid is being consumed by said fuel injector.

3. The method of claim 2 wherein a plurality of electronically-controlled hydraulically-actuated fuel injectors are connected to a common rail of pressurized actuation fluid with individual branch passages; and said step of estimating how much actuation fluid includes a step of estimating a rate that pressurized actuation fluid is being consumed by said fuel injectors.

4. The method of claim 3 wherein said step of estimating an actual amount includes a step of measuring a pressure differential across at least one actuation fluid flow orifice.

5. The method of claim 4 wherein said at least one actuation fluid flow orifice is a supply passage to said common rail.

6. A method of fuel injection comprising the steps of:

providing an electronically-controlled hydraulically-actuated fuel injector installed in an engine;

supplying a relatively low pressure fuel to said fuel injector;

operating said fuel injector with a nominal on-time for a plurality of injection cycles at least in part by hydraulically pressurizing fuel in said fuel injector to a relatively high pressure;

determining whether an injection amount from said fuel injector for said nominal on-time has changed by a certain percentage; and operating said fuel injector with an adjusted on-time if the change is greater than said certain percentage.

7. The method of claim 6 wherein said determining step includes a step of estimating consumption of actuation fluid by said fuel injector.

8. The method of claim 6 wherein a plurality of electronically-controlled hydraulically-actuated fuel injectors are connected to common rail of pressurized actuation fluid; and said determining step includes a step of estimating flow out of said common rail of pressurized actuation fluid to said fuel injectors.

9. The method of claim 8 wherein said step of estimating flow includes a step of measuring a pressure differential across a flow orifice in a supply passage to said common source of pressurized actuation fluid.

10. The method of claim 6 further comprising a step of calculating a viscosity of a pressurized actuation fluid being supplied to said fuel injector; and lengthening an on-time for said fuel injector if said viscosity is greater than a predetermined viscosity.

11. The method of claim 6 wherein said determining step includes a step of determining whether an injection amount from said fuel injector for said nominal on-time has increased by predetermined percentage.

12. The method of claim 6 further comprising a step of recording a set of nominal on-times for said fuel injector.

13. The method of claim 6 a plurality of electronically-controlled hydraulically-actuated fuel injectors are connected to common rail of pressurized actuation fluid;

said determining step includes a step of estimating an actual amount of fuel injected by said fuel injectors; and comparing said actual amount of fuel to a nominal amount of fuel.

14. The method of claim 13 wherein said estimating step includes a step of estimating an amount of actuation fluid consumed by said fuel injectors.

15. The method of claim 14 wherein said step of estimating an amount of actuation fluid includes a step of measuring a pressure differential across a flow orifice in at least one actuation fluid flow passage.

16. The method of claim 15 wherein said at least one actuation fluid flow passage includes a supply passage to said common rail of pressurized actuation fluid.

17. A hydraulically actuated fuel injection system comprising:

a source of relatively low pressure fuel;

a common rail containing a pressurized actuation fluid at a relatively high pressure;

a plurality of electronically-controlled hydraulically-actuated fuel injectors connected to said common rail installed in an engine and said source of relatively low pressure fuel; and means, including an electronic control module and a sensor, for estimating an amount of fuel actually injected by said fuel injectors.

18. The system of claim 17 wherein said sensor is a pressure differential sensor in communication with said electronic control module and being operably positioned across a flow orifice in a supply passage to said common rail.

19. The system of claim 18 further comprising a set of nominal injector on-times stored in a memory location accessible to said electronic control module.

20. The system of claim 19 wherein said source of relatively low pressure fuel includes fluid that is different from said actuation fluid.

* * * * *